United States Patent [19]

Chandler et al.

[11] Patent Number: 4,891,022

[45] Date of Patent: Jan. 2, 1990

[54] SHIELDED DATA CONNECTOR

[75] Inventors: Curtis S. Chandler, King; Edward K. Marsh, Kernersville, both of N.C.

[73] Assignee: AMP Incorporated, Harrisburg, Pa.

[21] Appl. No.: 262,142

[22] Filed: Oct. 21, 1988

Related U.S. Application Data

[63] Continuation of Ser. No. 945,403, Dec. 22, 1986, abandoned.

[51] Int. Cl.[4] ..... H01R 9/03

[52] U.S. Cl. ..... 439/610; 439/509; 439/879; 439/750

[58] Field of Search ..... 439/607-610, 439/98, 99, 733, 741, 746, 748, 750, 751, 509, 879

[56] References Cited

U.S. PATENT DOCUMENTS

| | | | |
|---|---|---|---|
| 2,941,028 | 6/1960 | Edlen et al. | 339/177 R |
| 3,474,385 | 10/1969 | Cefarelli et al. | 339/47 |
| 4,272,148 | 6/1981 | Knack | 339/143 R |
| 4,310,213 | 1/1982 | Fetterolf, Sr. et al. | |
| 4,449,778 | 5/1984 | Lane | 339/143 R |
| 4,501,459 | 2/1985 | Chandler et al. | 339/48 |
| 4,508,415 | 4/1985 | Bunnell | 339/143 R |
| 4,582,376 | 4/1986 | Olsson | 339/19 |
| 4,602,833 | 7/1986 | Grabbe et al. | 339/19 |
| 4,611,878 | 9/1986 | Hall et al. | 339/143 R |
| 4,619,494 | 10/1986 | Noorily et al. | 339/103 M |
| 4,653,825 | 3/1987 | Olsson | 339/143 R |
| 4,682,836 | 7/1987 | Noorily et al. | 439/426 |

FOREIGN PATENT DOCUMENTS

| | | | |
|---|---|---|---|
| 0093992 | 11/1983 | European Pat. Off. | 339/143 R |

OTHER PUBLICATIONS

EPO Search Report dated 11-19-87.

AMP Inc. Instruction Sheet IS3188 (released 2-12-87), "AMP *Shielded Champ* 180° Connector Kits and Cover Kits".

IBM Technical Disclosure Bulletin dated Oct. 1973 entitled "Hermaphroditic Connector".

U.S. patent application Ser. No. 773,730 filed Sep. 6, 1985 (Docket #13477).

U.S. patent application Ser. No. 823,134 filed Jan. 27, 1986, (Docket #13619).

U.S. patent application Ser. No. 830,904 filed Feb. 18, 1986, (Docket #13231).

*Primary Examiner*—David Pirlot

*Attorney, Agent, or Firm*—Eric J. Groen

[57] ABSTRACT

A data connector is disclosed herein which includes a plurality of terminals situated in an insulative housing, and the housing is surrounded by shielding members to form a shielded subassembly, the shielded subassembly finally being inserted within a premolded one piece boot to form a data connector which is interconnectable to shielded data cable. The data connector of the instant invention can be field assembled and installed and is intermatable with similar data connectors having T-bars and T-slots without the complexity thereof. Alternatively, the data connector of the instant invention is interconnectable with a communications outlet locally mounted which houses similar terminals electrically interconnected to like shielded data cable.

2 Claims, 9 Drawing Sheets

SHIELDED DATA CONNECTOR

This application is a continuation of application Ser. No. 945,403, filed 12/22/86, now abandoned.

BACKGROUND OF THE INVENTION

1. Field of the Invention

The invention relates to electrical connectors for use in terminating shielded multiconductor cables and more specifically to shielded local area network electrical connectors.

2. Description of the Prior Art

U.S. Pat. No. 4,501,459 discloses a local area network connector specifically intended for use in the data communications industry. These connectors can be employed in a closed loop data communications link in which various equipment such as computer terminals can be interconnected in a system. These connectors are specifically adapted for use in interconnecting numerous micro or mini computers in a computer network in an office environment. Connectors of this type have standard interface dimensions and configurations. These connectors must also be shielded to prevent spurious electrical signals and noise from affecting the signals in the network. These connectors also require a shunting capability since the conductors are part of a network and can be connected in series with other similar connectors. This shunting capability is necessary to prevent disruption of the network when an individual plug is not connected to external equipment.

The structure and components of local area network connectors of this type is represented by the structure of the connector shown in U.S. Pat. No. 4,501,459. These connectors include a plurality of spring metal terminals having insulation displacement wire barrels for establishing electrical connection with the individual conductors forming the multi conductor shielded cable. Terminals are positioned on a support housing and upper and lower shields can be positioned in surrounding relationship to the terminals and the support housing. Shield members are permanently attached to upper and lower cover members and the cover members are mated to both encapsulate the conductor and to common the upper and lower shields to the cable shielding.

Similar data connectors of this type are shown in U.S. Pat. Nos. 4,449,778; 4,508,415; 4,582,376; 4,602,833; and 4,619,494; and in U.S. patent application Ser. Nos. 773,730, filed Sept. 6, 1985; 830,904, filed 2/18/86 and 823,134, filed 1/7/86. U.S. patent application Ser. No. 773,730 in particular relates to a data connector which utilizes a housing slidably receivable over the internal housing subassembly. Although the data connector shown in the application Ser. No. 773,730 provides an excellent interconnection for a shielded multiconductor cable in a local area network, the data connector is designed for assembly in a harness assembly plant. As the post molded grommet must be molded after the assembly thereof, the data connector cannot be field assembled, and the cable must be cut to specific lengths in the harness assembly plant.

There exists within the industry a need for a low cost local area network connector of this general type which can be easily hand assembled at the end user's facility. The instant invention fills that need for a relatively lower cost, by providing a hand assembled connector which is suitable for use in a local area network in combination with prior art connectors of the type described herein.

SUMMARY OF THE INVENTION

The preferred embodiment of this invention comprises a local area network connector for interconnecting thereto a plurality of conductors in a muticonductor cable having cable shielding surrounding the individual insulated conductors. The connector includes generally an internal housing which supports a plurality of spring metal terminals. Shield members surround the housing member and are latchably attahed to each other. Portions extending from each of the shield members are attachable to the cable shielding by means of a collapsible ferrule. A one piece premolded boot member is slidably received over this assembly to totally encapsulate the inner housing and the shield members within the insulative housing.

Although the connector is profiled to latchably attach to the connectors of the prior art mentioned above, the instant invention does not include T-bars and T-slot, as do the prior art connectors. Rather, the connector boot member includes raised detents on the outer surface thereof profiled to latch with the T-bar and T-slot on the connectors of the prior art.

BRIEF DESCRIPTION OF THE DRAWINGS

FIG. 3 is an isometric view similar to FIG. 1 showing the shielded subassembly partially exploded from the premolded boot.

FIG. 8 shows the data connector of FIG. 7 in a mated relationshp.

DETAILED DESCRIPTION OF THE PREFERRED EMBODIMENT

Figures 1, 7:
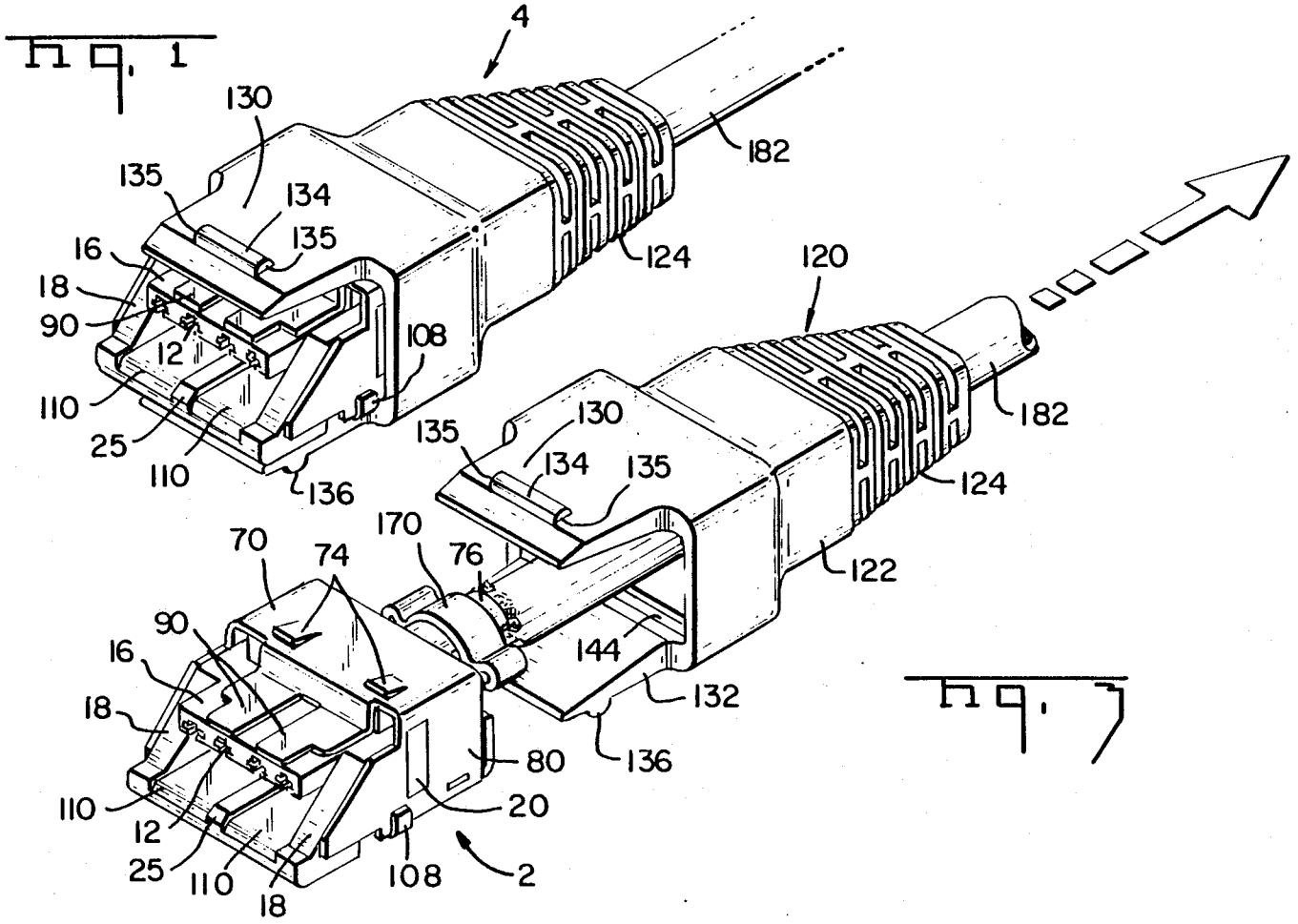
FIG. 1 is an isometric view of the data connector of the instant invention.
FIG. 7 is a side plan view showing the data connector poised for receipt in a communications outlet.
Figure 2:
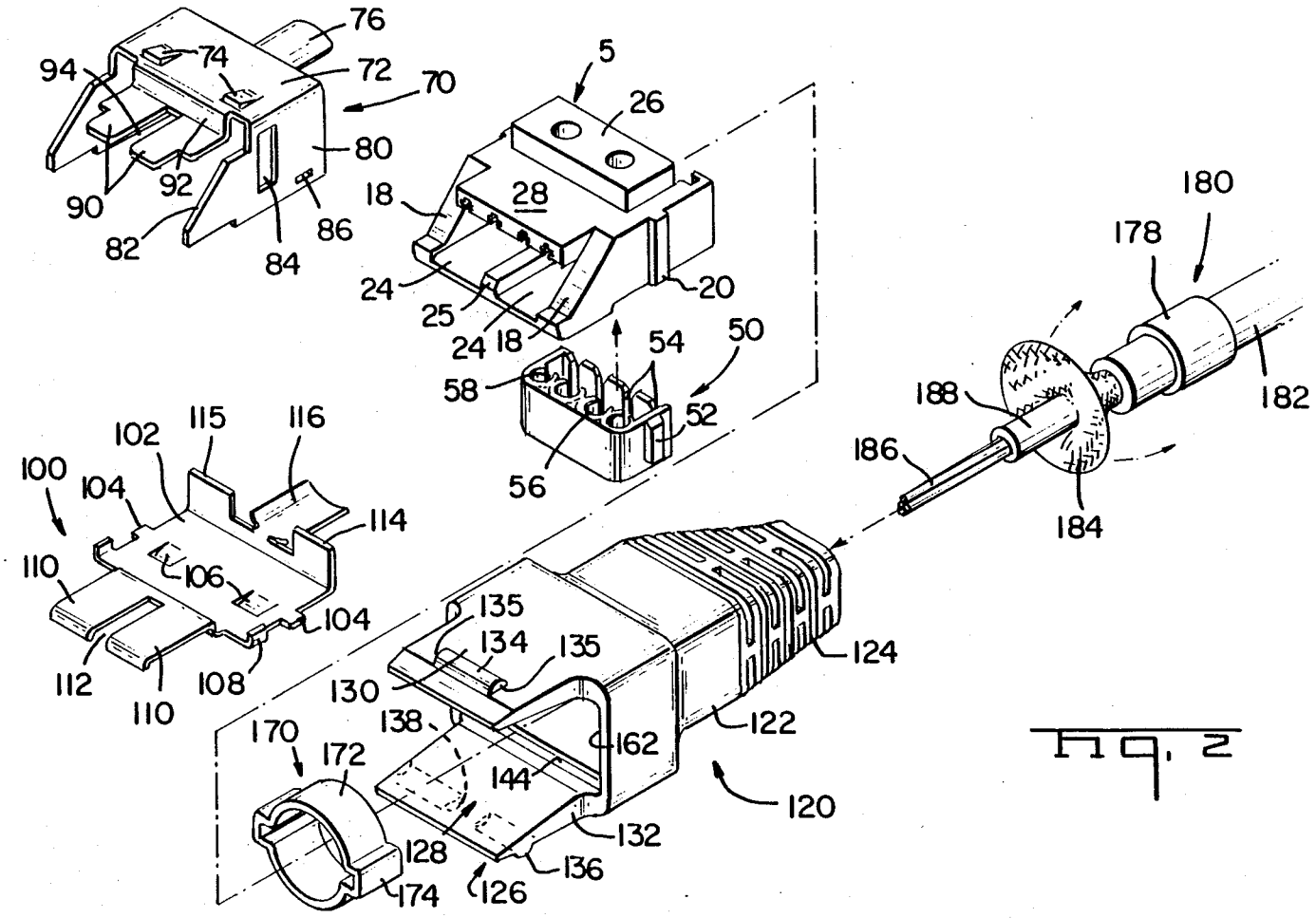
FIG. 2 is an isometric view of the data connector of FIG. 1 showing the components exploded.

Referring first to FIGS. 1 and 3, the data connector 4 of the instant invention generally comprises a shielded subassembly 2 and a premolded boot 120, the shielded subassembly 2 being slidably receivable into and out of the premolded boot 120 and being latchably attached therein. Referring now to FIG. 2, the shielded subassembly 2 generally includes a housing member 5, a stuffer cap 50, and shield members 70 and 100. The data connector housing 5 will be described in greater detail, with reference to FIGS. 2 and 4.

Figure 4:
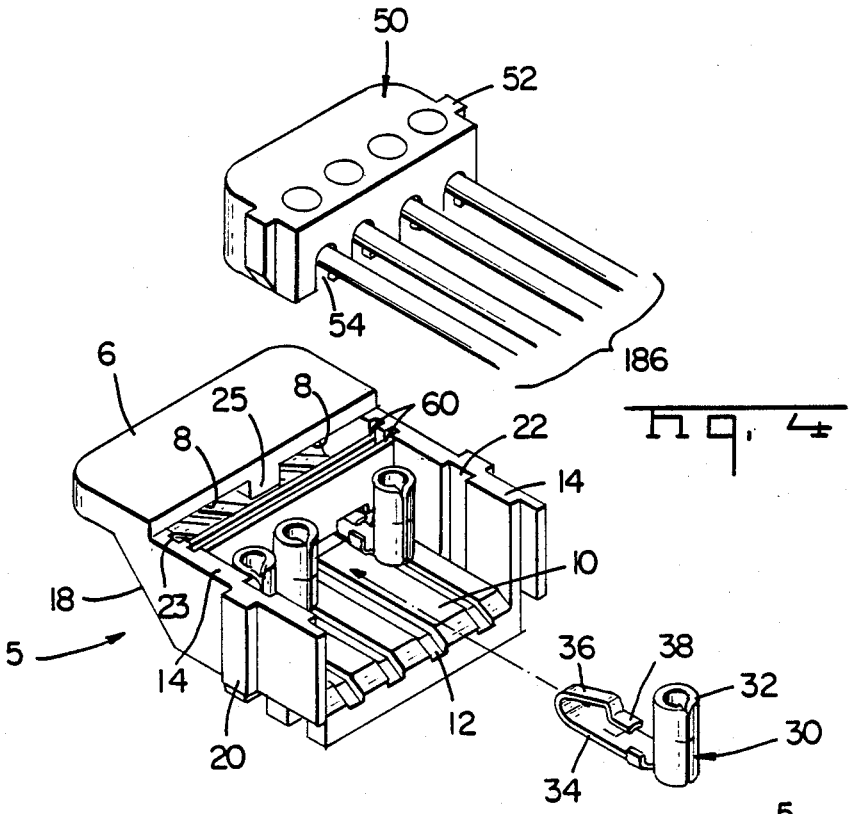
FIG. 4 is an isometric view of the housing subassembly.

With reference first to FIG. 4, the housing 5 generally comprises a terminal support floor 10 having a plurality of channels 12 therein for receiving terminals 30. Extending upwardly from the terminal support floor are sidewalls 14 having internal grooves 22 and external ribs 20. A bridge portion 6 extends across the two sidewalls to define a front mating face for the data connector. Extending below the bridge 6 is a rib 25 which extends from the rear edge of the bridge (FIG. 4) to the forward edge of the bridge (FIG. 2). The rib 25 defines two windows 8 which also extend from the rear edge of the bridge to the forward edge of the bridge to define two shield receiving surfaces 24 (FIG. 2). The sidewalls 14 extend from the rear of the data connector 4 to the front mating face of the data connector to define two 45 degree surfaces at the front mating face, referred to generally as 18.

Terminals 30 include insulation displacement wire barrels 32, a blade portion 34, a resilient contact portion 36 and a commoning foot 38. The resilient contact portion 36 is looped back upon itself and spaced above the terminal support floor. The resilient contact portion 36 is disposed at the front mating face of the housing 5 for overlapping interconnection with like terminals, the two resilient contact portions of mating connectors contacting each other to deflect respective resilient contact portions towards the blade portion of respective terminals. Stuffer cap 50 includes alignment ribs 52 along the sides, wire receiving slots 54 and stuffer cylinders 56, the stuffer cylinders 56 having an inside diameter larger than the outside diameter of the barrels 32 of the terminals 30.

Figure 5:
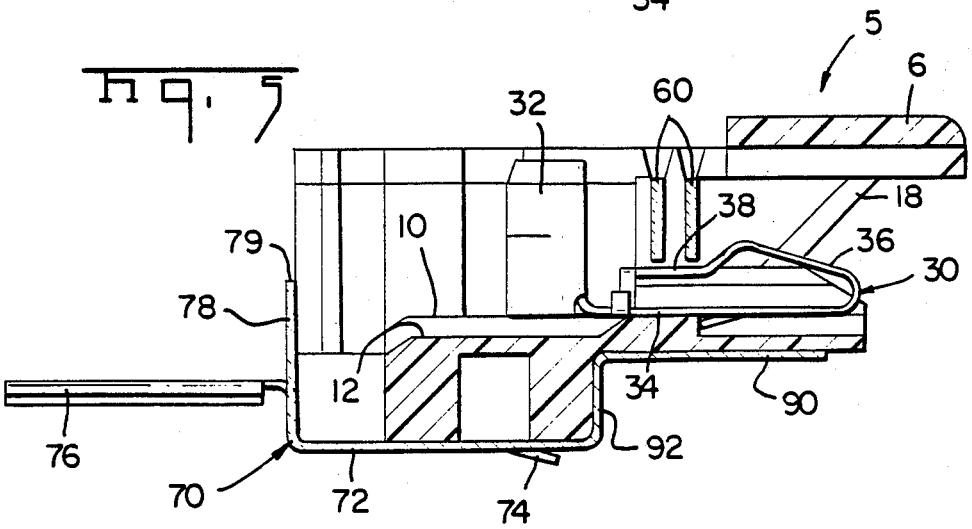
FIG. 5 is a cross-sectional view of the insulative housing with the lower shield in place.

Referring now to FIG. 2 only, the shield member 70 includes a plate member 72 with continuous shield members 90 extending from the plate member 72 through a bent portion 92, the two shield members 90 defining a slot 94 therebetween. The plate member 72 further includes two locking lances 74. The shield member 70 is shown in FIG. 5 as including a rear wall 78 extending from the plate member 72 with a semicircular shielding tail 76 extending from the rear wall 78. With reference again to FIG. 2, the shield member 70 further includes integral sidewalls 80 having windows 84 and 86 stamped therefrom. The forward edges of the sidewalls 80 are defined by two 45 degree surfaces 82.

Shield member 100 is shown as including a plate member 102 with integral shielding portions 110 extending from the front edge thereof, the two shield members 110 defining a slot 112 therebetween. The shield member 100 further includes a rear wall portion 114 having a semicircular shield tail 116 extending from the rear wall 114. Plate member 102 further comprises locking lances 106, and tabs 104 and 108 extending from the side edges thereof.

Figure 6A:
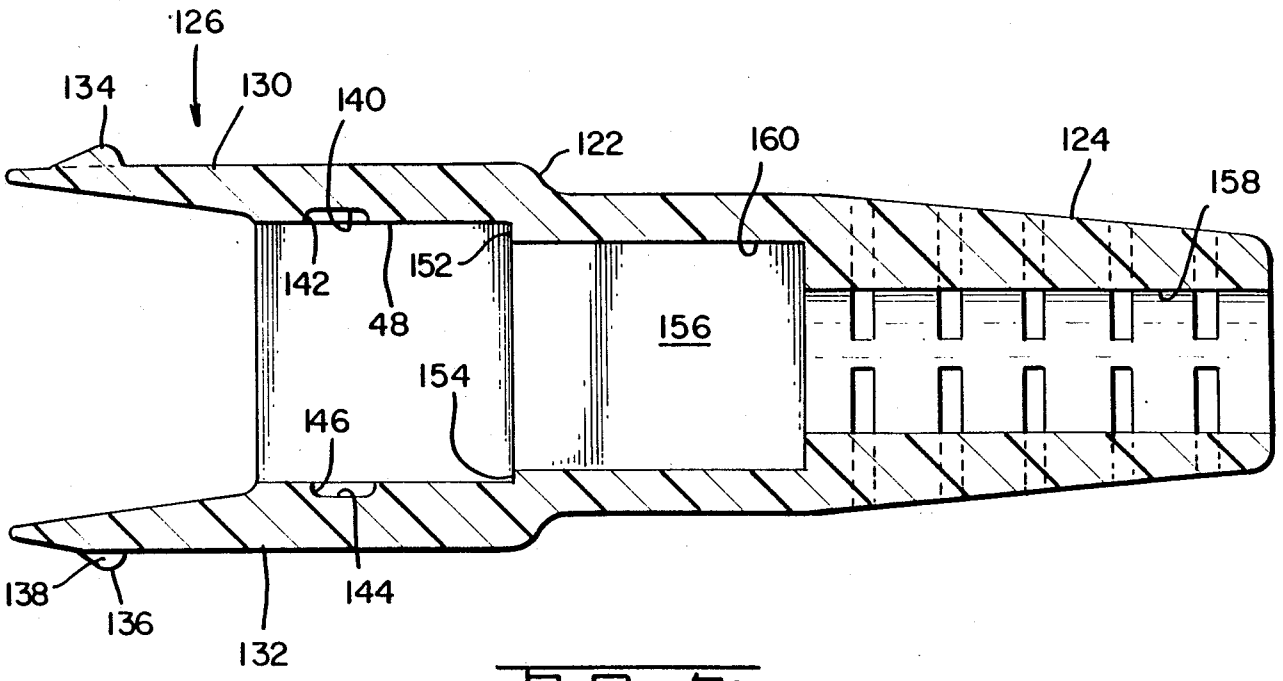
FIG. 6A is a cross-sectional view of the premolded boot of the instant invention.

With reference still to FIG. 2, the premolded boot 120 includes a central body portion 122, a flexible portion 124 and a latching portion 126. Referring now to FIG. 6A, the internal structure of the premolded boot generally includes a cable receiving bore 158, a cavity 156 and a connector receiving cavity 128. The cavity 156 is defined by an inner bore 160, while the connector receiving cavity 128 is defined by an upper surface 148, a lower surface 150 and sidewalls 162 (FIG. 2). The upper surface 148 includes a transversely extending channel 140 therein having a forward edge 142 while the lower surface 150 has a transversely extending channel 144 therein with a forward edge 146. The latching mechanism 126 generally comprises a latching extension 130 and a latching extension 132. The latching extension 130 includes a single latching projection 134 having end surfaces 135 (FIG. 2). The latching extension 132 includes two latching projections 136, the latching projections being spaced apart to define a slot 138 therebetween. The latching projections 134, 136 are defined as raised detents, the use and functioning of which will be described in greater detail herein.

With reference to FIG. 2, the assembly further includes a ferrule 170 having semicircular portions 172 and collapsible portions 174. The data connector 4, as shown in FIG. 2, is for interconnection to a shielded cable shown generally as 180. The shielded cable 180 includes outer insulation 182, a shielding braid 184, inner insulation 188 and individual insulated conductors 186. An inner metallic ferrule 178 is profiled to be slidably received over the outer insulation 182.

To interconnect the shielded cable 180 to the data connector of the instant invention, the housing portion 5, of FIG. 4, is first assembled. With the shorting bars 60 removed, the terminals 30 are slidably received in respective channels 12 until latched in place. The shorting bars 60 are then inserted in respective grooves 23, the shorting bars 60 contacting the commoning foot 38 on alternate terminals to common alternate terminals when the data connector 4 is in an unmated condition. It should be understood that to insert the shielded cable through the bore 158 of the premolded boot 120, the shielded cable must be in an unprepared condition, whereas the cable 180, as shown in FIG. 2, is shown in a prepared condition. Said another way, the cable must be left unstripped so that the blunt end alone is inserted into the bore 158, similar to threading a needle. With the shielded cable 180 inserted through the bore 158 of the boot 120, the boot can be pulled back on the cable to allow room for preparation of the cable end. Prior to preparing the end of the shielded cable but subsequent to placing the premolded boot 120 onto the cable, a metal ferrule 178 having an inner diameter substantially the same as the outer diameter of the insulation 182 is slidably received over the cable 180. Also a collapsible ferrule 170 is slid over the end of the cable and is placed back upon the cable with the premolded boot for later use.

The end of the shielded cable can then be prepared by stripping a portion of the outer insulation from the end of the cable to expose a portion of the shield 184. The ferrule 178 is then placed adjacent to the end of the stripped insulation and the exposed shielding braid 184 is dressed over the ferrule 178, as shown in FIG. 2. The inner insulation 188 is then stripped to expose the insulated conductors 186 and each individual wire 186 is placed in the stuffer cap through a respective slot 54, with the ends of the wire 186 extending into the barrels 56 through the slot 58. The stuffer cap 50 and the individual wire 186 are then placed over the insulative housing 5 such that ribs 52 on the stuffer cap 50 are aligned with channels 22 in the insulative housing 5, which in turn aligns the stuffer cap barrels 56 with the insulation displacement wire barrels 32 on the terminals 30. The stuffer cap 50 is then pushed downwardly until each of the individual conductors 186 is terminated within respective wire barrels 32 of terminals 30.

The shielded subassembly 2 is completed by installing the shield members 70 and 100 to the insulative housing 5. The shield member 70 is first inserted over the housing 5 such that windows 84 in the shield 70 overlie the ribs 20 of the housing 5. This places plate member 72 adjacent to the surface 26 of the housing and shield members 90 adjacent to surface 28 of the housing. Furthermore, and as shown in FIG. 5, as installed, the rear wall 78 of the shield member lies adjacent to the rear of the connector housing 5 to substantially shield the housing member 5. This also places semicircular shielding tail 76 in an overlying relationship with the dressed braid 184, trapping the braid between the ferrule 178 and semicircular portion 76. The shield member 100 is next installed by placing forward shield members 110 through the windows 8 of the connector housing 5 such that the forward shield members 110 lie flush against the forward surfaces 24 and between the rib 25. The shield member 100 is latched in place by locking the tabs 104 into the windows 86 of the shield member 70. As shown in FIG. 3, the tabs 108 overlap the shield sidewalls 80 to keep the tabs 104 and the windows 86 in a latched condition.

As installed, the plate member 102 of the shield member 100 overlies the terminals 30 within the connector housing 5. The rear wall 114 of the shield member 100 encloses the rear edge of the connector housing 5 with edge 115 of the rear wall 14 substantially adjacent to edge 79 (FIG. 5) of rear wall 78 to totally enclose the connector housing. Also as installed, the semicircular shield tail 116 overlies and is substantially adjacent to the dressed braid and the backup ferrule 178. The previously installed ferrule 170 can then be slid forwardly to overlie the semicircular shield tails 76 and 116, and the ferrule 170 can be crimped to a configuration as shown in FIG. 3. The collapsible ferrule provides for a permanent electrical connection between the shielding components, that is, the shielding braid 184 is trapped between the metal backup ferrule 178 and between the metallic shield tails 76 and 116.

Figure 6B:
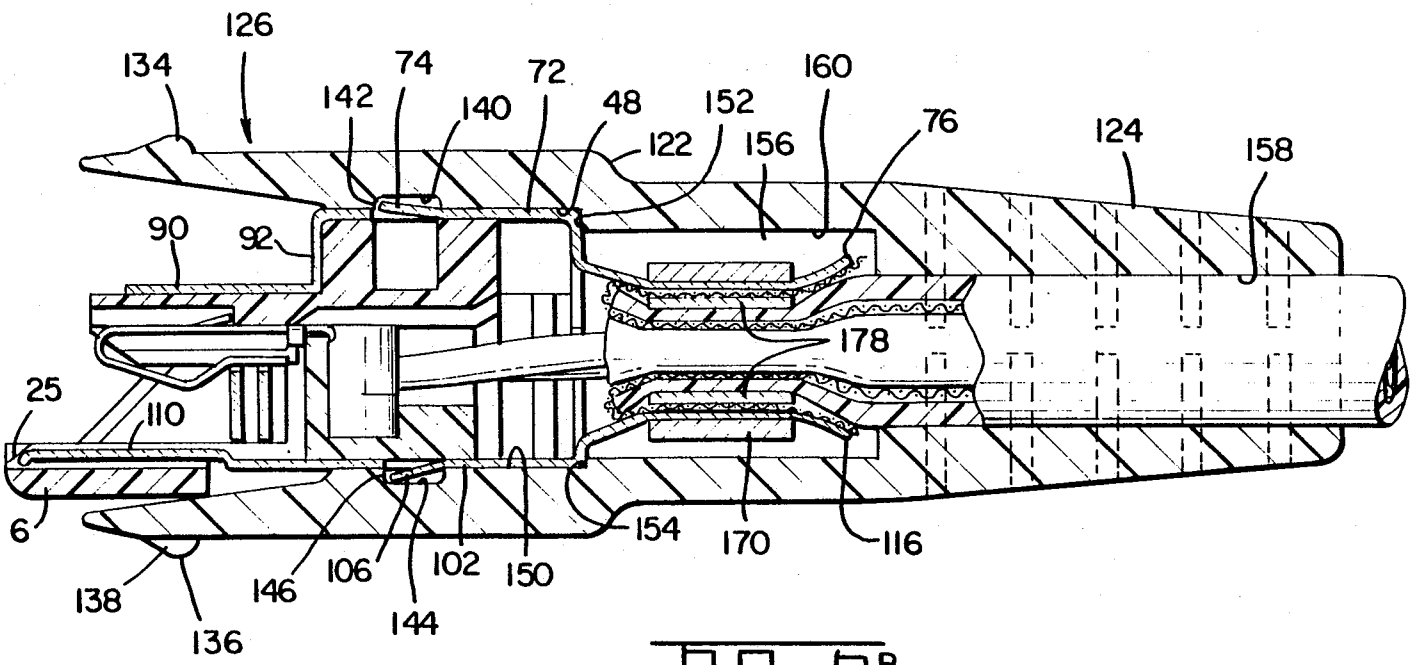
FIG. 6B is a cross-sectional view, similar to that of FIG. 6A, showing the assembled data connector of FIG. 1.
Figure 7:
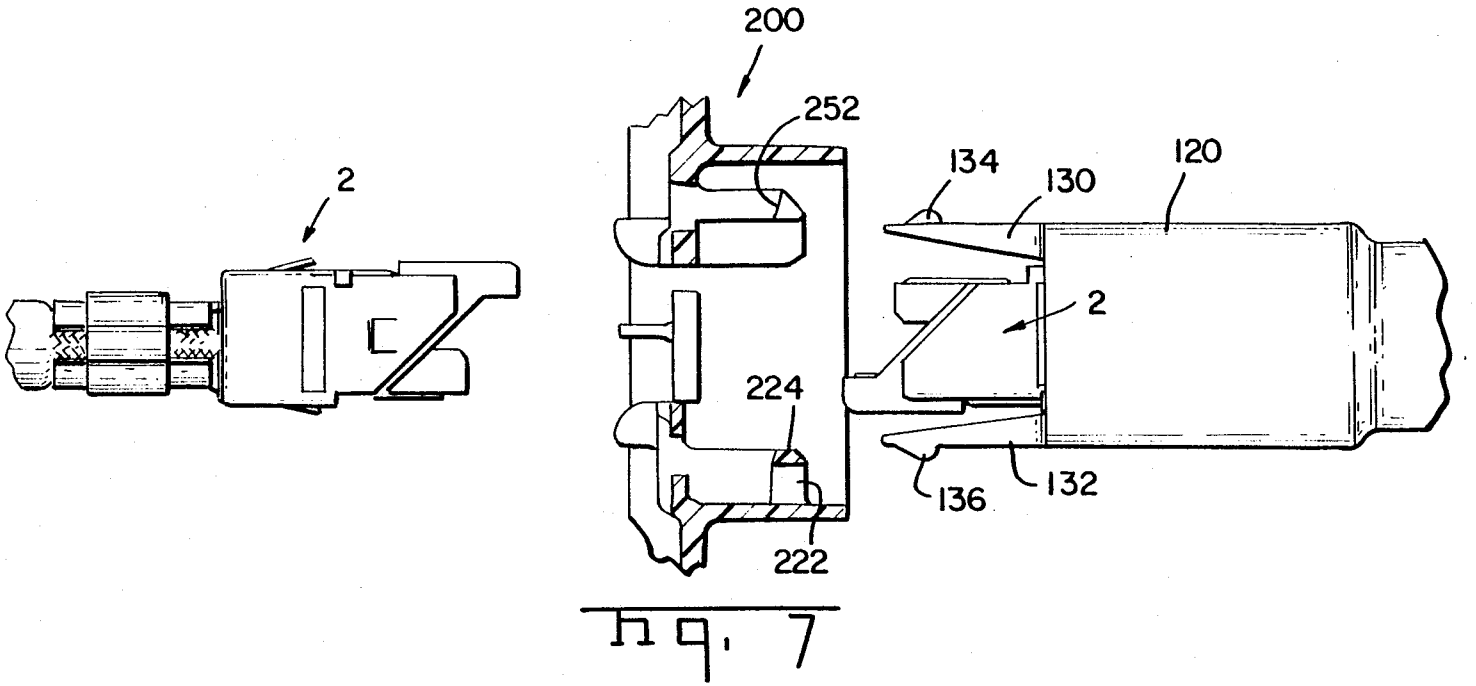
Figure 6:
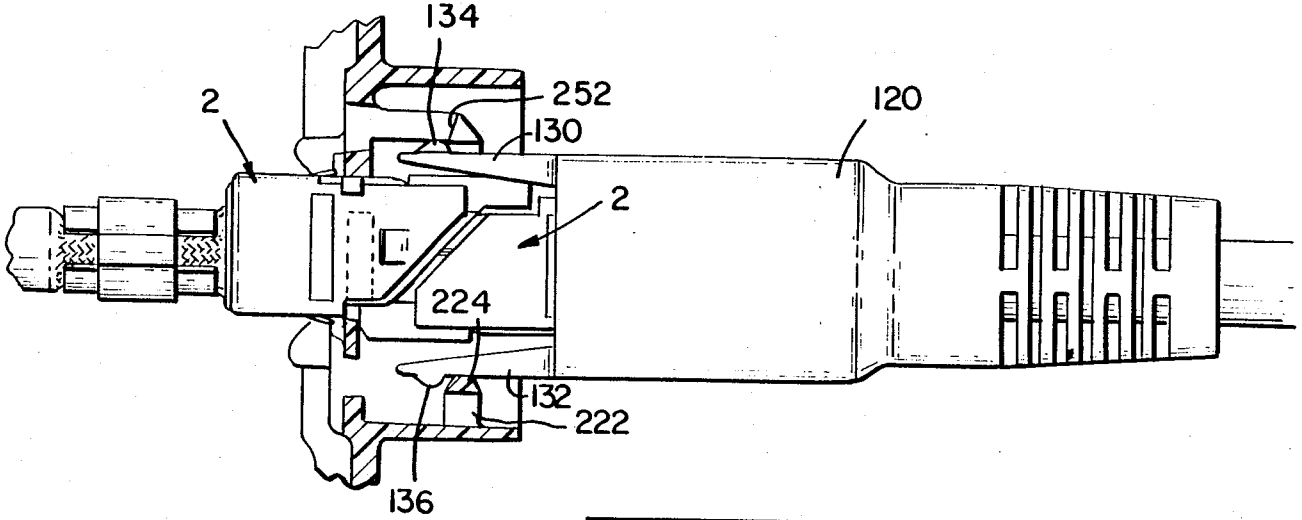

With the individual conductors 186 terminated to the respective terminals 30, and with the shielded braid 184 commoned to the shielded subassembly 2, the shielded boot 120 can now be slid forwardly to encapsulate and insulate the shielded subassembly 2. The premolded boot 120 and the shielded subassembly 2 are pulled together until the rear walls 78, 114 of the shield members 70 and 100, respectively, abut the shoulders 152 and 154, respectively, within the premolded boot 120, as shown in FIG. 6B. This disposes the crimp assembly of the collapsible ferrule within the cavity 156 and the shielded subassembly within the cavity 128. The cavity 128 is closely toleranced to receive the shielded subassembly 2, that is shielded plate members 72 and 102 lie substantially flushly with surfaces 148 and 150, respectively. Furthermore, the sidewalls 80 of the shield member 70 lie substantially flushly with the inner sidewalls 162 of the premolded boot. As installed, the locking lances 74 and 106 are disposed within the transverse channels 140 and 144, respectfully, and are latched against surfaces 142 and 146, respectfully.

It should be understood that the assembly as previously described can be installed within the user's facility without any assembly equipment. At most, a pocket knife is required to strip the cable and a pair of pliers is required to push the stuffer cap down to terminate the insulated conductors. Data communication lines are installed within office buildings, or the like, much like the installation electrical power wiring, or telephone wire. Often new offices are modularly formed or new terminals are needed to compliment preexisting computer terminals. It is advantageous to have the ability to wire the data connectors at the facility without regarding to the lengths of runs required in the cable lengths. When a new shielded cable is installed, the desired method is to run the cable through the walls or through channels in the flooring to dispose the ends of the shielded cable at the required locations. The ends of the shielded cables are then prepared and the data connectors installed.

A first advantage of the present invention is that the premolded one piece boot provides an economic advantage to the user, over previous prior art connectors. Second, the user can stock gross lengths of unprepared shielded cable, typically bought in rolls of hundreds of feet, and only terminate the shielded cable to data connectors when necessary. This method of stocking components is much easier and cost effective than stocking a large quantity of lengths of cable with preterminated data connectors at each end thereof. Third, the present invention allows the unprepared cable to be fed through small openings in the flooring or the walls which is an imperative requirement for the new installation of any type of wiring. Feeding the cable through openings would not be possible with a cable preterminated to a data connector.

Figure 9:
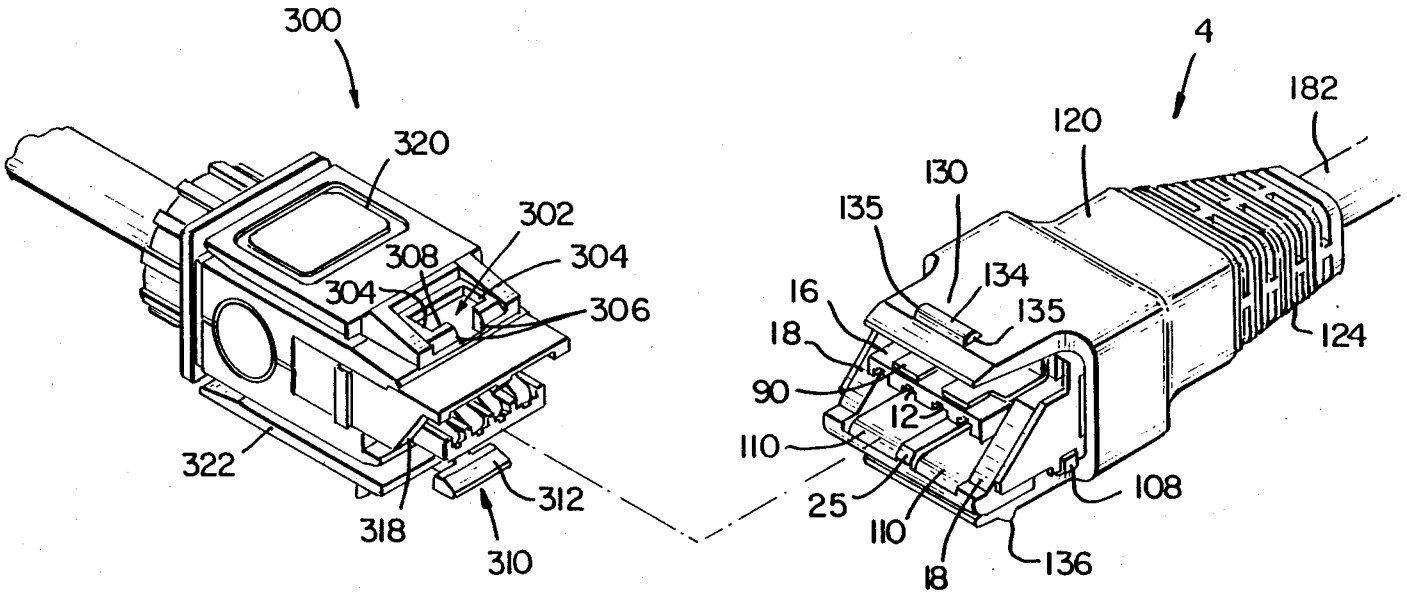
FIG. 9 is an isometric view showing the data connector of the instant invention poised for receipt in a data connector having a T-bar and a T-slot.
Figure 10:
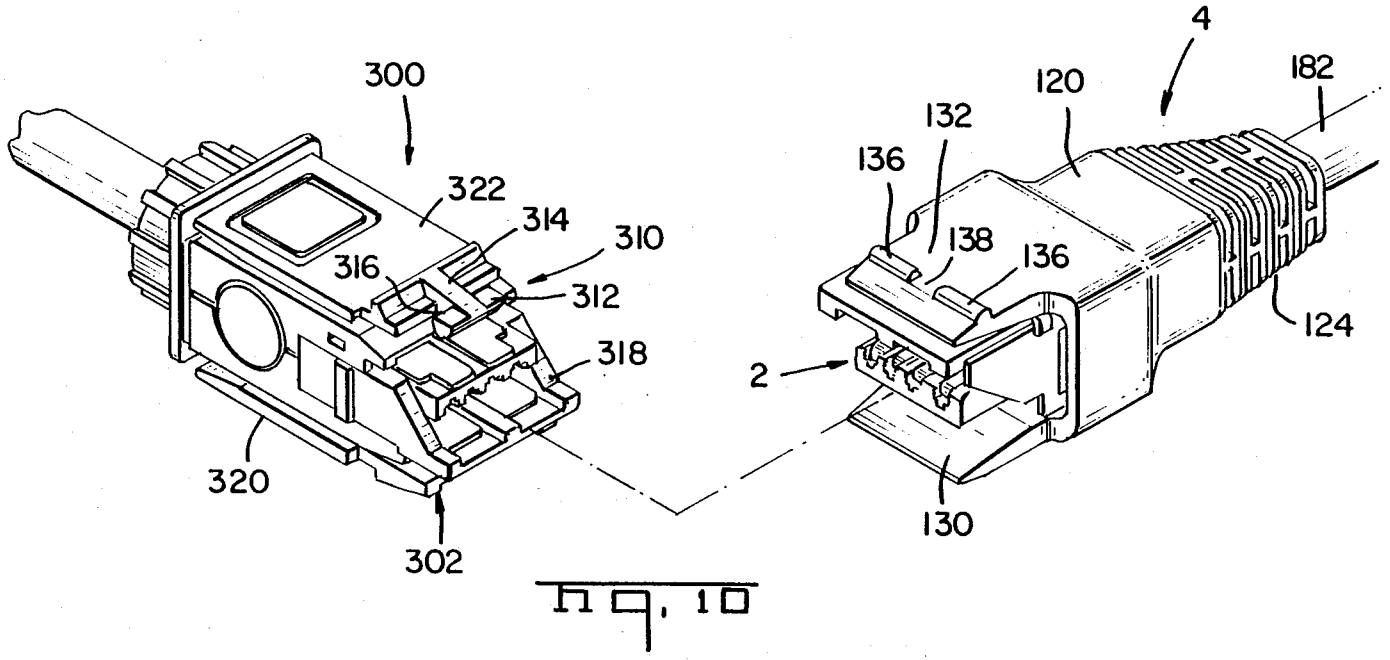
FIG. 10 is a view similar to that of FIG. 9 showing the latchability of the T-bar with the two raised detents.

Further advantages relate to the intermatability of the presently designed data connector. As assembled, the data connector 4 is matable with a wall outlet 200, as shown in FIG. 7, or with a hermaphroditic data connector 300, as shown in FIGS. 9 and 10. The wall outlet 200 shown in FIG. 7 is described more fully in co-pending application Serial No. 945,401, entitled "Data Communications Outlet", Attorney's Docket 13877, filed concurrently herewith, the disclosure of which is incorporated herein by reference. Therefore the outlet 200 will only be briefly discussed herein. The data connector 300 shown in FIG. 9 is generally of the type disclosed in U.S. Pat. Nos. 4,449,778; 4,501,459; 4,508,415; 4,582,376; and 4,602,833; and in U.S. patent application Ser. Nos. 773,730; 830,904; and 823,134; the disclosures of which are incorporated herein by reference.

With respect to the intermatability of the data connector 4 with the data communications outlet 200, the data connector 4 of the instant invention is profiled to interconnect to the front face of the outlet 200 for electrical interconnection thereto. The outlet is profiled with a T-slot 240 and a T-bar 220 for matable interconnection with the latching projections 134 and 136.

As shown in FIG. 9, the data connector is also interconnectable with a data connector 300. The latching mechanism of the data connector 300 includes a latch plate 320 and a latch plate 322. The forward end of the latch plate 320 includes a T-slot 302 defined by edges 304 and edges 306 defining a slot therebetween. A latching surface 308 is also defined within the T-slot 302. The latching projection 134 on the premolded boot 120 has end edges 135. The premolded boot 120 is profiled such that, upon mating of the data connector of the instant invention with the data connector 300, the latching extension 130 is slidably received under the latching plate 320 of the data connector 300. This disposes the latching projection 134 within the T-slot 302 with the edges 135 of the latching projection 134 between the end surfaces 304 of the T-slot 302 and the latching projection 134 behind latching surface 308 of the T-slot 302.

Referring now to FIG. 10, the T-bar 310 is shown in greater detail. The T-bar 310 of the data connector 300 generally includes a bar portion 312 and an arm portion 314 interconnected to the plate portion 322. The bar portion 312 and the arm portion 314 defines a latching surface 316 on the back side of the bar portion 312. The latching projections 136 on the data connector of the instant invention define a slsot 138 therebetween. When in the mated position, the T-bar 310 of the data connector 300 is latched with the projections 136, such that the arm portion 314 is disposed within the slot 138 with the latching surface 316 of the bar portion 312 behind the latching projections 136.

Furthermore, identical shielded subassemblies 2 can either be used with the communication outlet 200 or can be used with the premolded boot 120. A typical installation of the preferred embodiment of the invention would include an outlet 200 connected to the outside of a wall, within an office building, with data communication cable similar to the shielded cable 180 within the wall or under the floor, and terminated, as previously described, to a shielded subassembly 2. The shielded subassembly 2 would then be latchably received to the back of the communication outlet 200, as shown in FIG. 8. The data connector 4, having an identical shielded subassembly 2 as in the communication outlet 200, is then matably received with the front face of the outlet 200 to interconnect resilient contact portions 36 of like terminals 30. Given that identical shielded subassemblies are required for either the data connector or the communication outlet 200, the component parts for the shielded subassembly can be easily stocked without a predetermined end to their use. Furthermore, the identical shielded subassemblies allow retrofitting of a previously assembled data connector into a communication outlet, or vise verse, a previously assembled communication outlet into a data connector.

The preferred embodiment of the invention was disclosed by reference to the specific drawings herein and with specific reference to the terminology used in the state of the art to which the invention relates in order to illustrate and exemplify the preferred practice of the invention, but not to restrict its scope; the appended claims being reserved to that end.

What is claimed:

1. An electrical connector for electrical interconnection with a shielded multiconductor data cable comprises:

an insulative housing means having terminal supporting means including a platform for the receipt of a plurality of electrical terminals, and sidewalls upstanding from the platform, the platform and the sidewalls defining an open upper face of the housing means, a plurality of electrical terminals including base portions for mounting on the platform, the base portions being in transition with reversely bent portions forming resilient contact portions, the contact portions extending rearwardly to free ends of the terminals, the contact portions being intermatable with like contact portions in a complementary connector, the terminals further comprising wire connecting portions extending from ends of the terminal base portions, shield means securable to the housing means, and surrounding the exterior of the sidewalls, the exterior of the platform, and enclosing the open upper face of the housing means, the shield means further comprising semicircular shielding extensions which integrally extend from a rear of the shield means, and a one-piece ferrule having two semicircular portions having at least one collapsible portion interconnecting the two semicircular portions, whereby when the ferrule is slid over an end of the multiconductor data cable and the individual conductors of the multiconductor data cable are terminated to the wire connecting portions of the terminals, and the shield means is enclosed over the insulative housing means, the ferrule can be slid forward to overlie the semicircular shielding extensions, and the collapsible portion of the ferrule can be crimped thereby moving the semicircular portions of the ferrule uniformly radially inward to electrically trap a shielding braid of the data cable in electrical connection with the shield means.

2. The connector of claim 1 wherein the ferrule includes collapsible portions diametrically opposed from each other, whereby upon crimping the collapsible portions, each of the semicircular portions of the ferrule move uniformly and radially inward towards the center of the data cable.

* * * * *